US006076699A

United States Patent [19]

Seager et al.

[11] Patent Number: 6,076,699

[45] Date of Patent: Jun. 20, 2000

[54] DRINKING CUP AND LID

[75] Inventors: Richard H. Seager, Mystic, Conn.; Lon E. Frye, Batavia, Ill.

[73] Assignee: Dinex International, Inc., Conn.

[21] Appl. No.: 09/174,053

[22] Filed: Oct. 15, 1998

[51] Int. Cl.[7] ..... B65D 23/10

[52] U.S. Cl. ..... 220/710.5; D7/533; D7/536; 215/396; 215/398; 220/592.17; 220/703; 220/755; 220/771

[58] Field of Search ..... 220/703, 710.5, 220/771, 592.17, 23.83, 755; 206/508; 215/393, 396, 398; D7/533, 536

[56] References Cited

U.S. PATENT DOCUMENTS

| | | | |
|---|---|---|---|
| D. 5,738 | 4/1872 | Ballinger | D7/9 |
| D. 165,782 | 1/1952 | Parker, Jr. | 220/771 X |
| D. 166,832 | 5/1952 | Thompson et al. | 220/710.5 X |
| D. 218,471 | 8/1970 | Stone | D7/536 |
| D. 314,309 | 2/1991 | Thorpe | D7/536 |
| 2,564,834 | 8/1951 | Devine et al. | 206/508 X |
| 2,770,957 | 11/1956 | Bronson | 220/23.83 |
| 3,079,037 | 2/1963 | Schechter | 215/393 X |
| 3,456,864 | 7/1969 | Trombley et al. | 229/402 |
| 3,719,304 | 3/1973 | Douglas | 220/805 X |
| 4,995,524 | 2/1991 | Welles | 215/393 X |
| 5,531,353 | 7/1996 | Ward et al. | 220/630 X |
| 5,558,240 | 9/1996 | Karp | 229/402 X |
| 5,918,761 | 7/1999 | Wissinger | 220/592.17 |

*Primary Examiner*—Gary E. Elkins
*Assistant Examiner*—Joe Merek
*Attorney, Agent, or Firm*—Bachman & LaPointe, P.C.

[57] ABSTRACT

The present invention relates to an improved drinking cup. The drinking cup includes a bottom portion and a sidewall portion integrally formed therewith. The sidewall portion defines a liquid holding cavity and has an upper peripheral edge which defines an opening through which a liquid can be placed within and withdrawn from the liquid holding cavity. The drinking cup further includes a laterally extending handle attached to the sidewall portion. The handle has an upper thumb rest portion including a raised portion for preventing a user's thumb from contacting the sidewall portion and inadvertently dislodging a lid placed over the opening. A lid for cooperating with the cup is also disclosed.

18 Claims, 4 Drawing Sheets

DRINKING CUP AND LID

BACKGROUND OF THE INVENTION

The present invention relates to an improved cup and lid design for insuring that users do not inadvertently remove the lid from the cup and for allowing cups to be stacked.

Insulated drinking cups for holding hot liquids and cold liquids are well known in the prior art. U.S. Design Pat. No. 314,309 to Thorp illustrates one such drinking cup. As can be seen from this patent, the handle used with this drinking cup is designed to have an upper portion on which a user can rest his/her thumb as the liquid within the cup is being consumed. Unfortunately, the design of this handle allows the end of the user's thumb to contact the cup sidewall in an area adjacent the rim. As a result, it is possible for a user, resting his/her thumb on the handle, to inadvertently catch a lid covering the cup and dislodge it from the cup. This can be a particularly dangerous problem if the liquid in the cup is extremely hot. This problem becomes even more serious in certain institutional settings wherein the users are elderly or infirm people.

Institutional use of drinking cups of the type shown in the aforesaid patent often requires filled drinking cups to be stacked for distribution purposes. Thus, there is a need for cup lids which are positively sealed to the cup and which enable sealed cups to be stacked in a secure manner.

SUMMARY OF THE INVENTION

Accordingly, it is an object of the present invention to provide a drinking cup with an improved handle design which prevents a user's thumb from inadvertently dislodging a lid on the cup.

It is a further object of the present invention to provide an improved lid design for said drinking cup which forms a better seal with the cup and which allows for stacking of the cups.

The foregoing objects are attained by the drinking cup of the present invention.

In accordance with the present invention, an improved drinking cup is provided. The drinking cup includes a bottom portion and a sidewall portion integrally formed therewith. The sidewall portion defines a liquid holding cavity and has an upper peripheral edge which defines an opening through which a liquid can be placed within and withdrawn from the liquid holding cavity. The drinking cup further includes a laterally extending handle attached to the sidewall portion. The handle has an upper thumb rest portion including means for preventing a user's thumb from contacting the sidewall portion and inadvertently dislodging a lid placed over the opening. A lid is disclosed which may be used with the cup of the present invention. The lid has a locking rib for frictionally engaging an annular ridge on the interior wall of the cup. The lid is further designed to allow cups to be stacked.

Other details of the drinking cup of the present invention, as well as other objects and advantages attendant thereto, are set forth in the following detailed description and the accompanying drawings wherein like reference numerals depict like elements.

BRIEF DESCRIPTION OF THE DRAWING(S)

DETAILED DESCRIPTION OF THE PREFERRED EMBODIMENT(S)

Figure 1:
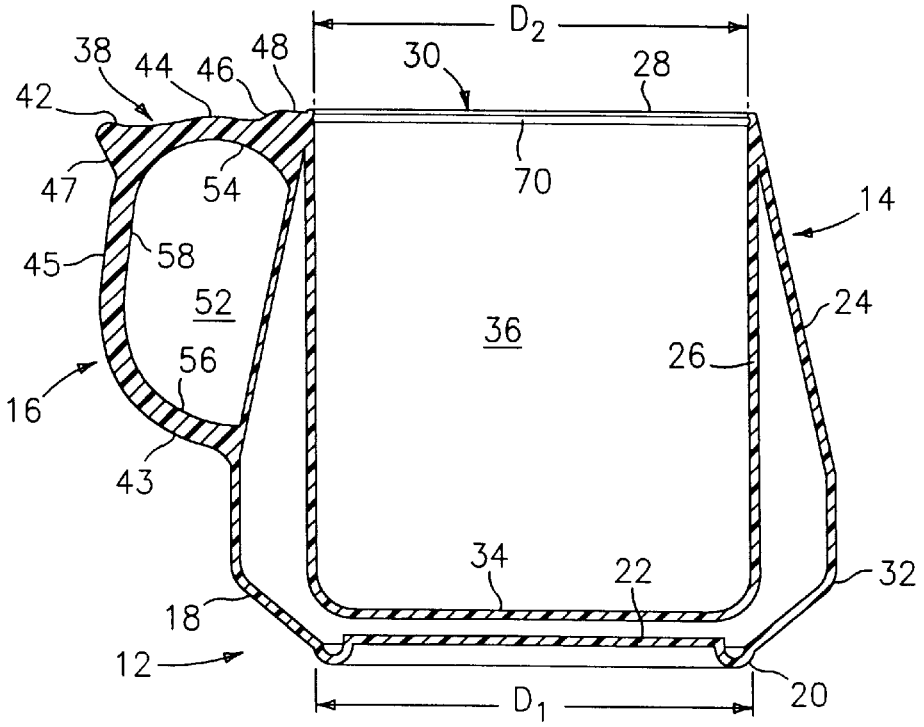
FIG. 1 is a sectional view of a cup in accordance with the present invention.
Figure 2:
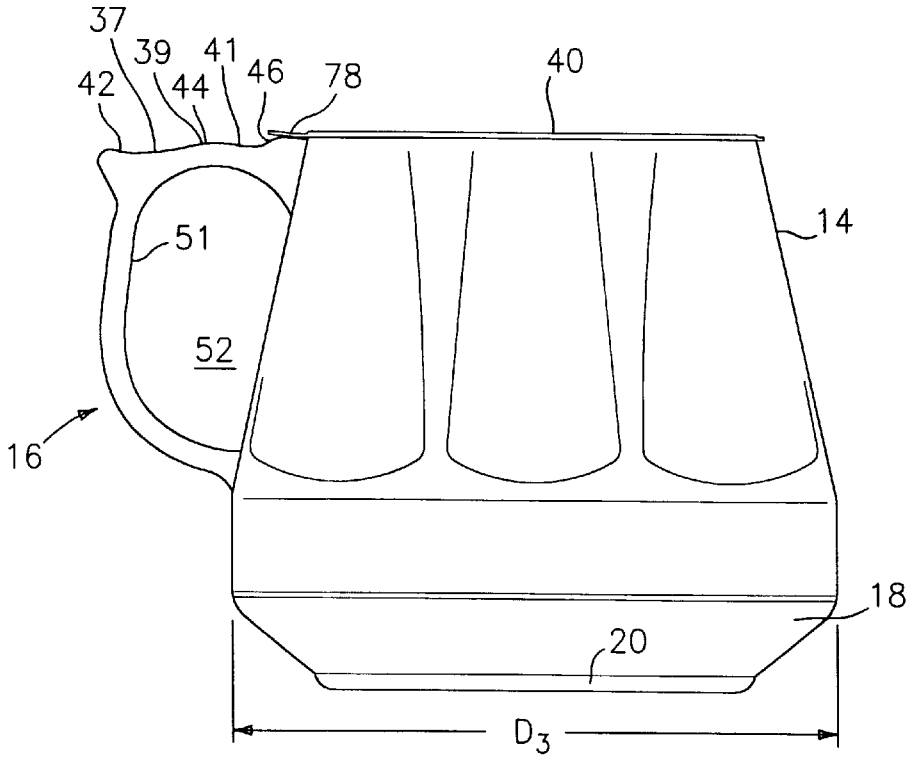
FIG. 2 is a side view of a cup in accordance with the present invention with a lid.
Figure 3:
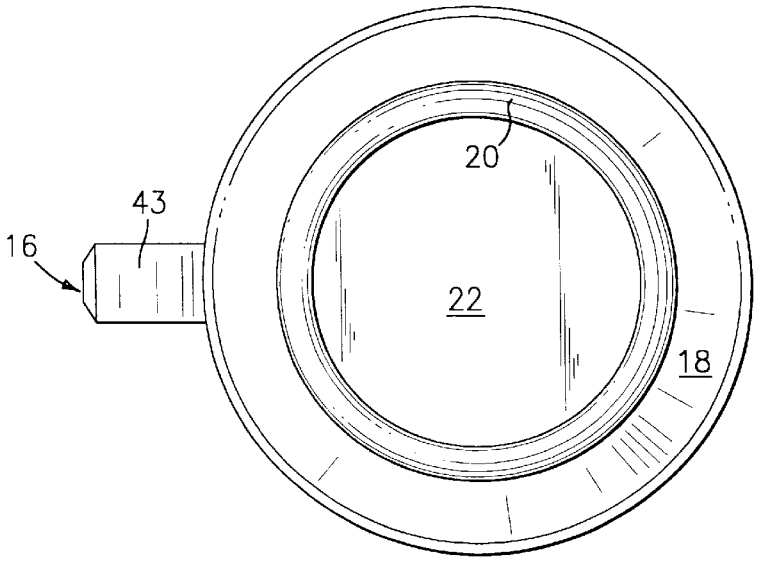
FIG. 3 is a bottom view of the cup of FIG. 2.

Referring now to the drawings, FIGS. 1–3 illustrate a drinking cup 10 in accordance with the present invention. The drinking cup may be used to hold hot or cold liquids and is preferably formed from an insulative, liquid impervious, thermoplastic material.

The cup 10 includes a bottom portion 12 and a sidewall portion 14 integrally formed with the bottom portion 12. The cup further includes a laterally extending handle 16 for allowing a user to grip the cup, which handle 16 is integrally formed with the sidewall portion. The handle 16 is preferably designed to allow the cup to be used by both right-handed and left-handed users.

The bottom portion 12, in one embodiment of the present invention, includes a conically shaped portion 18, an annular support ring 20, and a substantially flat central portion 22. The support ring 20 is designed to support the cup 10 on a surface. It has an outer diameter $D_1$.

The sidewall portion 14 has an outer surface 24, an inner surface 26, and an upper peripheral edge 28 defining an annular opening 30. The annular opening 30 preferably has a diameter $D_2$ which is smaller than the largest diameter $D_3$ of the bottom portion 12. Therefore, the outer surface 24 tapers inwardly as it extends from a point just above the upper edge 32 of the bottom portion 12 to the upper peripheral edge 28. The outer surface 24 could have any desired aesthetically pleasing design on it. For example, the outer surface 24 could be a smooth surface. Alternatively, it could have the design configuration shown in U.S. Design Pat. No. 314,309, which is incorporated by reference herein. Yet further, the outer surface 24 could include a swirl shaped pattern which extends from the base portion to a location a desired distance beneath the upper peripheral edge 28.

The inner surface 26 is preferably a substantially vertical surface extending between the upper peripheral edge 28 and an interior surface 34 of the bottom portion. The inner surface 26 and the interior surface 34 define a liquid holding cavity 36.

The handle 16, as previously discussed, is integrally formed with the sidewall portion 14. The handle 16 includes an upper thumb rest 38 and means for preventing a user's thumb from contacting the sidewall portion 14 and inadvertently dislodging a lid 40 covering the opening 30. The thumb rest 38 is formed by a solid, non-planar surface which ends in a outwardly extending, angled portion 42. The portion 37 of the thumb rest 38 extending from point 44 to the end of the portion 42 is concavely curved to substantially conform to the shape of a thumb. The point 44 is part of a convexly curved portion 39 which blends into portion 37.

The preventing means is formed by a raised portion comprising an upwardly angled portion 46 and a substantially lanar, slightly downwardly angled portion 48. A concavely curved portion 41 extends between the convexly curved portion 39 and the upwardly angled portion 46. The portion 48 has an upper surface which merges or mates with the sidewall portion 14 substantially at, and preferably at, the level of the upper peripheral edge 28. By providing such an arrangement, it is not possible for a user's thumb resting on the thumb rest 38 to contact the underside of the lid 40 and accidentally dislodge same. The upwardly angled portion 46 causes a user's thumb to lift as it approaches the sidewall portion 14 and thus avoid contact with the underside of the lid 40.

The external surface of the handle 16 further includes an arcuate surface 43 which merges and blends into the sidewall portion 14. A substantially vertical surface 45 extends between the arcuate surface 43 and an outwardly angled surface 47. The outwardly angled surface 47 and the outwardly extending portion 42 form a substantially V-shaped configuration.

The inner surface 51 of the handle 16 forms an enclosed space 52 with part of sidewall portion 14. The enclosed space 52 accommodates one or more of the user's fingers. Insertion of the finger(s) into the space 52 helps stabilize the cup 10 when one raises it to one's lips for drinking purposes. The inner surface is formed by upper and lower arcuate portions 54 and 56 and a substantially vertical wall 58 extending therebetween. The upper and lower arcuate portions 54 and 56 blend into the sidewall portion 14 where each meets the sidewall portion.

Figure 4:
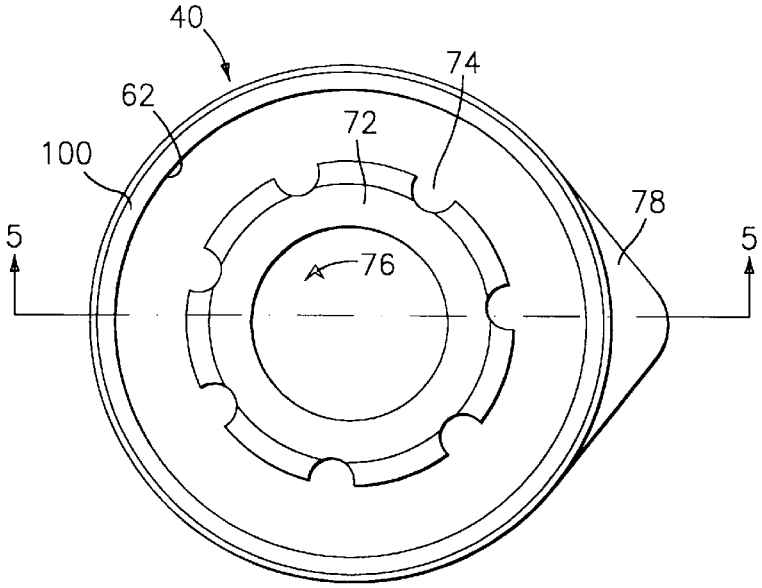
FIG. 4 is a top view of one embodiment of a lid to be used with the cup of the present invention.
Figure 5:
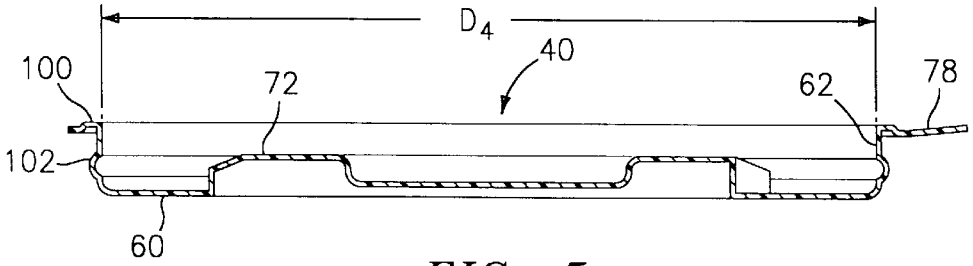
FIG. 5 is a sectional view of the lid of FIG. 4 taken along lines 5—5.

Referring now to FIGS. 4 and 5, a lid 40 may be provided to seal the opening 30 and prevent any spillage from the liquid holding cavity 36. The lid 40 includes an annular base portion 60 having an upwardly extending annular wall 62 which has a portion 100 which overlaps the upper peripheral edge 28 of the cup 10. The annular wall 62 further includes a locking rib 102 which engages an annular locking structure 70 on the interior of cup wall 26. As shown in FIG. 1, this annular ridge is positioned just beneath the upper peripheral edge 28. The rib 102 and the locking structure 70 frictionally engage to hold the lid 40 fast on the cup 10.

The lid 40 may include a tab 78 for allowing the lid to be removed. The tab 78 is formed by a relatively thin piece of plastic material.

When the lid 40 is seated on the cup 10, the lid portion 100 preferably overlaps and at least partially rests upon the handle portion 48. As a result, a user having his/her thumb on the handle 16 could not accidentally lift the lid 40 with his/her thumb so as to remove it from the cup. The same would be true even if the tab 78 was placed over the handle portion 48.

Figure 8:
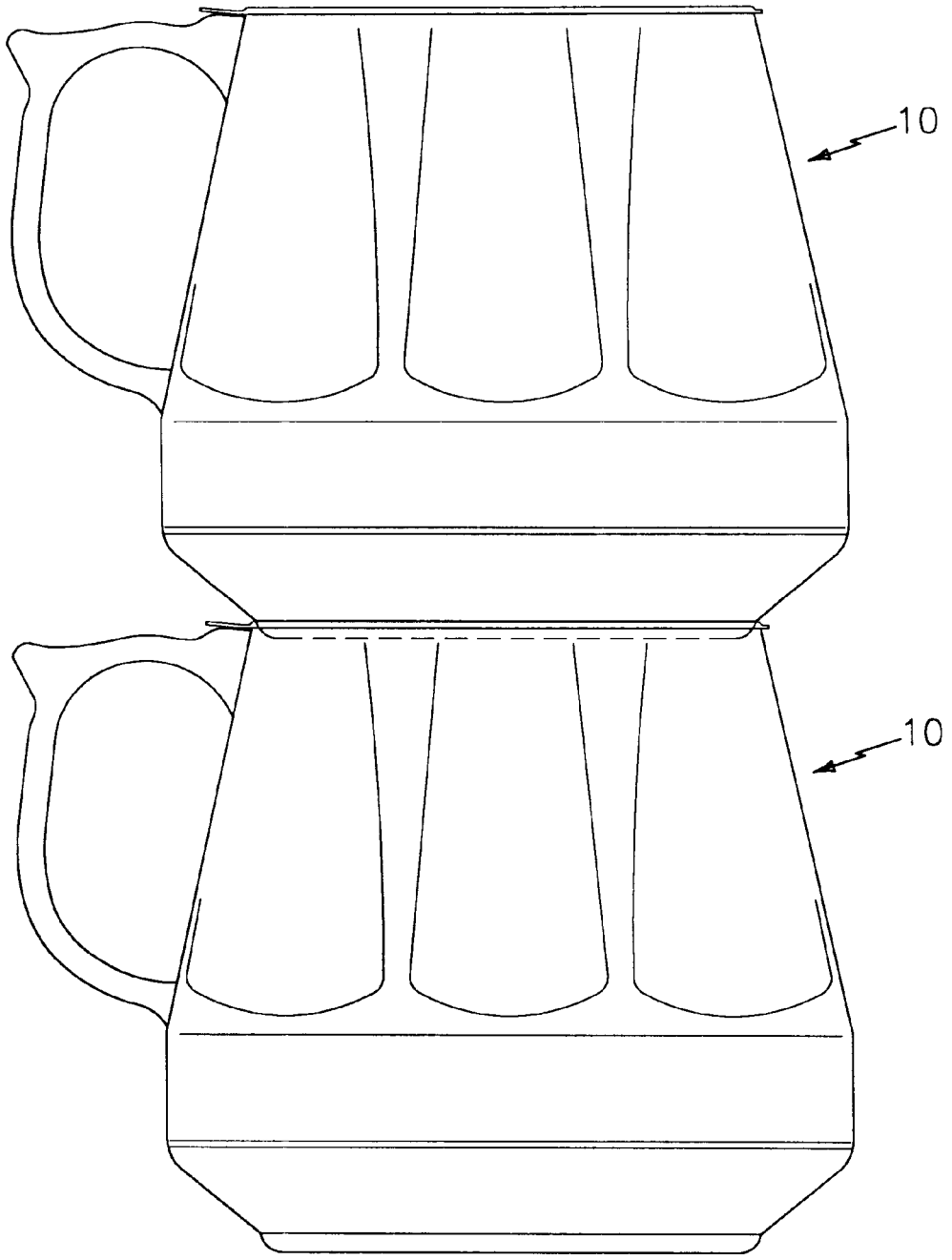
FIG. 8 is a side view illustrating a plurality of stacked cups.

The annular wall 62, in a preferred construction of the lid 40, has an inner diameter $D_4$ which is slightly larger than the diameter $D_1$ of the support ring 20. This allows a plurality of cups 10 to be stacked as shown in FIG. 8. Further, this allows the lid 40, when not sealing the opening 30, to be placed on a surface and act as a support base for the cup 10.

As shown in FIGS. 4 and 5, the lid 40 also includes a raised annular central portion 72 which is dimensioned to fit within the interior of the support ring 20. This annular central portion 72 facilitates stacking by providing a means for properly locating the stacked cups. If desired, the annular central portion 72 may include one or more notches 74 for aesthetic purposes. Still further, the central portion 72 may include one or more vent holes 76.

One of the advantages to the lid design of FIGS. 4 and 5 is that there is no downwardly extending external flange which can be inadvertently contacted so as to cause the lid 40 to dislodge from the cup.

Figure 6:
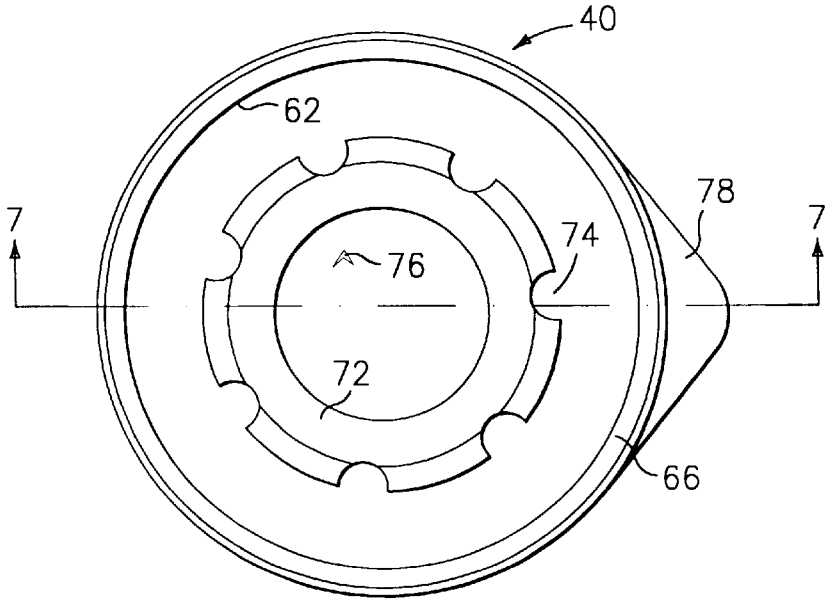
FIG. 6 is a top view of an alternative lid embodiment to be used with the cup of the present invention.
Figure 7:
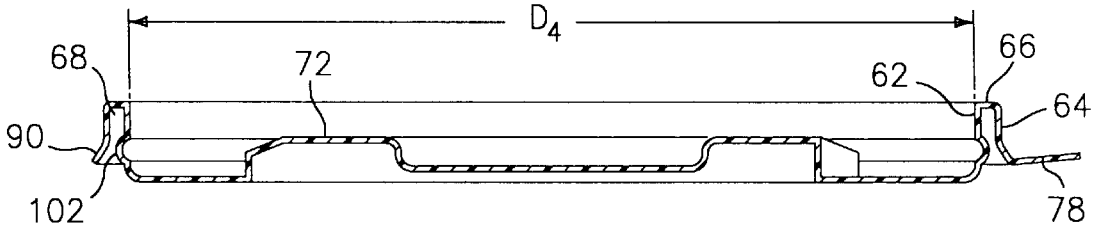
FIG. 7 is a sectional view of the lid of FIG. 6 taken along lines 7—7.

Another type of lid 40 which could be used with the cup 10 of the present invention is illustrated in FIGS. 6 and 7. As shown in these figures, the lid 40 may include an annular base portion 60, an upwardly extending annular wall 62, a downwardly extending annular peripheral edge wall 64, and a substantially flat annular surface 66 connecting upper edges of the walls 62 and 64. As shown in FIG. 7, the annular walls 62 and 64 form an annular groove 68 therebetween, which groove engages the upper peripheral edge 28. As previously discussed, the inner surface 26 of the sidewall portion 14 preferably includes an annular ridge 70 located just below the upper peripheral edge 28. The ridge 70 cooperates with the wall 62 so as to ensure a frictional engagement between the wall 62 and the surface 26 and a positive seal between the lid and the cup. To this end, the wall 62 may have a locking rib similar to that shown in FIG. 5.

As before, the upwardly extending wall 62 preferably has an inner diameter $D_4$ which is slightly larger than the diameter $D_1$ of the support ring 20. This allows a plurality of cups 10 to be stacked as shown in FIG. 8 and allows the lid 40, when not sealing the opening 30, to be placed on a surface and act as a support base for the cup 10.

If desired, the downwardly extending wall 64 may be provided with an outwardly extending flange 90 to facilitate removal of the lid from the cup. The downwardly extending wall 64 may also be provided with a cut-out portion (not shown) for accommodating the handle 16, and in particular the portion 48.

The lid embodiment of FIGS. 6 and 7 also includes a raised annular central portion 72 which is dimensioned to fit within the interior of the support ring 20. This annular central portion 72 facilitates stacking by providing a means for properly locating the stacked cups. If desired, the annular central portion 72 may include one or more notches 74 for aesthetic purposes. Still further, the central portion 72 may include one or more vent holes 76.

In order to facilitate removal of the lid 40 from the cup 10, a triangularly shaped tab 78 may be provided. As before, the tab 78 is formed from a flexible plastic material.

The lids 40 and their various components could be made out of any suitable plastic material known in the art. Preferably, the material is relatively thin and flexible, yet strong enough to support cups in a stacked arrangement.

As can be seen from the foregoing description, the present invention provides an improved cup which forms an improved seal with a lid and which has a handle which prevents inadvertent dislodgment of the lid, thus preventing spillage of liquid from the interior of the cup. It is believed that the improved handle of the present invention is better and stronger than conventional handles. Still further, the lid used with the cup of the present invention allows cups to be stacked which reduces the amount of storage space need to accommodate a plurality of cups and can be used as a stable support base for the cup to lift it off and protect surfaces.

While it is preferred to use lids which have a removal tab with the cups of the present invention, it is possible to use other types of lids, i.e. ones without a removal tab. Such lids of course would have to be designed to accommodate the novel handle of the present invention.

While the base portion of the cup has been described as having a bottom ring and a conically shaped portion, it should be recognized that the cup 10 could have other types of base portions. For example, the base portion could be substantially flat and have an annularly shaped support ring forming the outer periphery of the base.

While the sidewall portion of the cup has been described as being tapered, it should be recognized that the exterior surfaces of the sidewall portion could extend in a substantially vertical orientation if so desired.

It is apparent that there has been provided in accordance with this invention a drinking cup and lid which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A drinking cup comprising:

a bottom portion and a sidewall portion integrally formed with said bottom portion;

said sidewall portion and said bottom portion defining a liquid holding cavity and said sidewall portion having an upper peripheral edge which defines an opening through which liquid can be placed within and can be withdrawn from said liquid holding cavity;

a handle attached to said sidewall portion;

said handle having an upper surface formed by a solid, non-planar surface, said solid non-planar surface including a first concavely shaped portion, a second convexly shaped portion blending into said first portion, a third concavely shaped portion blending into said second portion, an upwardly angled portion adjacent said third portion, and a substantially planar, slightly downwardly angled portion adjacent said upwardly angled portion; and said upwardly angled portion and said substantially planar, slightly downwardly angled portion preventing a user's thumb from contacting said sidewall portion and inadvertently dislodging a lid placed over said opening.

2. A drinking cup according to claim 1, further comprising:

said substantially planar, slightly downwardly angled portion having an upper surface which mates with said sidewall portion substantially at the level of said upper peripheral edge.

3. A drinking cup according to claim 2, wherein said upper surface of said substantially planar, slightly downwardly angled portion mates with said sidewall portion at said upper peripheral edge.

4. A drinking cup according to claim 1, wherein said handle includes an interior surface and said interior surface forming with said sidewall portion a space through which a user can place at least one finger for stabilizing said cup as said cup is being held by said user.

5. A drinking cup according to claim 4, wherein said interior surface is formed by a substantially vertical portion and two arcuate portions, which arcuate portions blend into said sidewall portion.

6. A drinking cup according to claim 1, wherein said handle further includes an external surface which mates with said upper surface, said external surface including a first arcuate surface which mates with said sidewall portion, a substantially vertical extending surface adjacent to said first arcuate surface, and a substantially V-shaped portion adjacent said substantially vertical extending portion, said substantially V-shaped portion forming a part of said upper surface.

7. A drinking cup according to claim 1, wherein said bottom portion, said sidewall portion, and said handle are formed from an insulated thermoplastic material.

8. A drinking cup according to claim 7, wherein said insulated thermoplastic material is a liquid impervious plastic material.

9. A drinking cup according to claim 1, wherein said bottom portion includes an annular ring for supporting said cup on a surface.

10. A drinking cup according to claim 1, wherein the diameter of said opening is less than the maximum diameter of said base portion.

11. A drinking cup according to claim 1, wherein said sidewall portion has a substantially vertical wall defining said liquid holding cavity and said substantially vertical wall including an annular locking structure substantially adjacent said upper peripheral edge, said annular locking structure frictionally engaging a lid so as to create a positive seal.

12. A drinking cup according to claim 1, further comprising a lid for sealing said opening and preventing spillage of said liquid within said liquid holding cavity.

13. A drinking cup according to claim 12, wherein said lid comprises:

an annular base portion and a first annular wall joined to said annular base portion; and said first annular wall having a locking rib for frictionally engaging a locking structure on an interior surface of said cup and for holding said lid to said cup.

14. A drinking cup according to claim 13, further comprising:

said bottom portion including an annular support ring, said support ring having an outer diameter; and said first annular wall having an inner diameter slightly larger than said outer diameter for permitting drinking cups to be stacked.

15. A drinking cup according to claim 14, further comprising a raised annular portion joined to said base which is dimensioned to fit within said annular support ring.

16. A drinking cup according to claim 15, further comprising a plurality of notches within said raised annular portion.

17. A drinking cup according to claim 3, wherein said lid further includes a tab for facilitating removal of said lid from said cup.

18. A drinking cup according to claim 13, wherein said lid further comprises a downwardly extending annular wall and a flat portion extending between said downwardly extending annular wall and said first annular wall, said downwardly extending annular wall, said flat portion, and said first annular wall defining a groove in which said upper peripheral edge can be seated.

* * * * *